United States Patent [19]

Bissonnette

[11] Patent Number: 4,669,541

[45] Date of Patent: Jun. 2, 1987

[54] STAGE CEMENTING APPARATUS

[75] Inventor: Harold S. Bissonnette, Wichita Falls, Tex.

[73] Assignee: Dowell Schlumberger Incorporated, Tulsa, Okla.

[21] Appl. No.: 784,401

[22] Filed: Oct. 4, 1985

[51] Int. Cl.[4] ..... E21B 34/14

[52] U.S. Cl. ..... 166/154; 166/332

[58] Field of Search ..... 166/154, 285, 289, 317, 166/332, 334, 381, 386, 387

[56] References Cited

U.S. PATENT DOCUMENTS

| | | | |
|---|---|---|---|
| 2,659,438 | 11/1953 | Schnitter | 166/154 |
| 3,071,193 | 1/1963 | Raulins | 166/332 |
| 3,223,160 | 12/1965 | Baker | 166/289 |
| 3,768,562 | 10/1973 | Baker | 166/332 X |

*Primary Examiner*—Stephen J. Novosad
*Assistant Examiner*—Thuy M. Bui
*Attorney, Agent, or Firm*—L. Wayne White

[57] ABSTRACT

A stage collar for stage cementing a well casing includes a slidable closing sleeve having ports alignable with ports in the stage collar case. These closing sleeve and stage collar ports communicate with an annulus around the well casing when the stage collar is open. A shift sleeve closes the ports during running in and is actuable by simple drill pipe movements to open and reclose the stage collar ports. The shift sleeve is operably coupled to the closing sleeve by a latch ring which locks the closing sleeve closed and cooperated therewith to form a smooth and substantially uniform inner stage collar bore. The drill pipe is operably connected to the stage collar by a screw-in or latch-in shifting tool which cooperates with the stage collar elements to form a fluidtight passage from the drill pipe to the annulus without entering the well casing interior. A dual stage shifting tool is also shown which permits a two-stage cementing operation to be performed with only one run down the hole.

23 Claims, 24 Drawing Figures

STAGE CEMENTING APPARATUS

BACKGROUND OF THE INVENTION

1. Technical Field

This invention relates generally to apparatus used in the primary cementing of wells. More specifically, the invention relates to stage collars used in multistage cementing operations.

2. Discussion of Related Art

During well drilling operations, particularly in areas such as the North Sea, gas sands and other weak or low pressure zones are frequently penetrated at shallow depths less than, for example, 2000 feet below sea level. These sand pockets or lenses tend to be randomly distributed and are difficult to detect except by drilling and wireline logging.

Due to their small size and low pressure, the energy in shallow gas pockets is relatively low but porosity and permeability can be high. Furthermore, the primary hydrostatic pressure control means, such as a mud column used to contain the gas lens pressure during drilling, is relatively low. If the primary hydrostatic control is lost, the result can be short-duration but violent gas flow, blowouts and/or undesirable and sudden platform setting.

Stage cementing is a technique which can be used to control and confine the shallow gas formations during and after cementing operations performed through a weak zone. The top of the first cementing stage is located above the weak zone. When it has been determined that the first stage has successfully sealed off the weak zone, the second stage can be completed. The resulting cement sheath which thus surrounds the well casing string replaces the drilled-out natural barriers and thus prevents vertical flow.

Stage collars are used in stage cementing to solve the problem of excessive cement hydrostatic pressure. Cementing hydrostatic pressure becomes excessive when a column of liquid cement exerts a pressure that exceeds the formation gradient. However, as cement sets, it will support its own weight and will not transmit the hydrostatic load of a liquid cement column above. Therefore, by building a column of cement in stages of a set cement column and liquid cement, the overall hydrostatic pressure at a given point in time is reduced.

Known stage collars also solve other problems associated with primary cementing of well casing by permitting the cement to be pumped through the drill pipe. When the cement is pumped through the drill pipe, the time and quantity of fluid needed to displace the cement are greatly reduced. Also, when it is necessary or desirable to cement to the surface, which is often done at shallow sites, the drill pipe cementing technique reduces cement waste to the volume of the drill pipe. Contamination is also reduced.

The known stage collars, however, have numerous drawbacks and undesirable features. Stage collars which are not drill pipe actuated require a drill-out procedure for the plugs, darts, seats, and other hardware. Many of the known collars require more than one run down the bore hole to perform a two-stage cementing operation. This greatly increases the time and cost required to complete a stage cementing operation.

Another problem with the known collars is that the closed collars can be accidentally reopened after the stage cementing operation is completed. Also, the stage collars so not adequately isolate the casing interior from the drill pipe, thus requiring the use of a well head closure device. Although drill pipe-actuated stage collars are known, such as disclosed in U.S. Pat. No. 3,768,562 issued to Baker, the collar does not have a uniform bore after removal of the drill pipe and actuating tool, and the collar is not locked closed. Furthermore, this known device is not a positive seal stab-in type design, and relies on sliding seal cups or isolation packers, which can wear down.

An apparatus for performing a two-stage cementing operation with one run down the hole is known; however, this apparatus requires drill-out to achieve a uniform bore. This drill-out procedure is an additional and costly step, and can damage the stage collar and reduce its ability to isolate the weak zone. This apparatus also requires the use of known length-compensating subs (bumper subs or slip joints) and associated tools. Also, the associated stage collar is not drill pipe actuated but, rather, is hydraulically actuated open and closed using plugs and darts.

SUMMARY OF THE INVENTION

The present invention provides a new stage collar and shifting tool to overcome the above-mentioned problems. The invention broadly contemplates a stage collar which can be operated or actuated by drill pipe movements and which provides a direct passage from the drill pipe to the casing annulus without entering the casing interior.

According to one aspect of the invention, a stage collar is shown which can be opened and closed by axial movement of the drill pipe and, when closed after a cementing operation, is locked closed so as not to be accidentally reopened.

According to another aspect of the invention, a stage collar is provided which has a generally uniform and smooth inner diameter bore after the stage collar is locked closed without having to drill out the collar. The stage collar is opened and closed by means which are connectable to the drill pipe via a shifting tool. A fluid-tight passage is provided between the frill pipe and the annulus surrounding the casing, yet provides a uniform bore upon completion of the cementing operation. The need for darts and plugs to hydraulically actuate the stage collar is obviated by the instant invention.

The present invention also broadly contemplates a dual stage shifting tool which permits a two-stage cementing operation to be performed with only one run down the hole. The dual stage shifting tool is particularly adapted for actuating the new stage collar.

These and other aspects of the present invention will be more fully described and understood from the following specification in view of the accompanying drawings.

DETAILED DESCRIPTION OF THE PREFERRED EMBODIMENT

Figure 1:
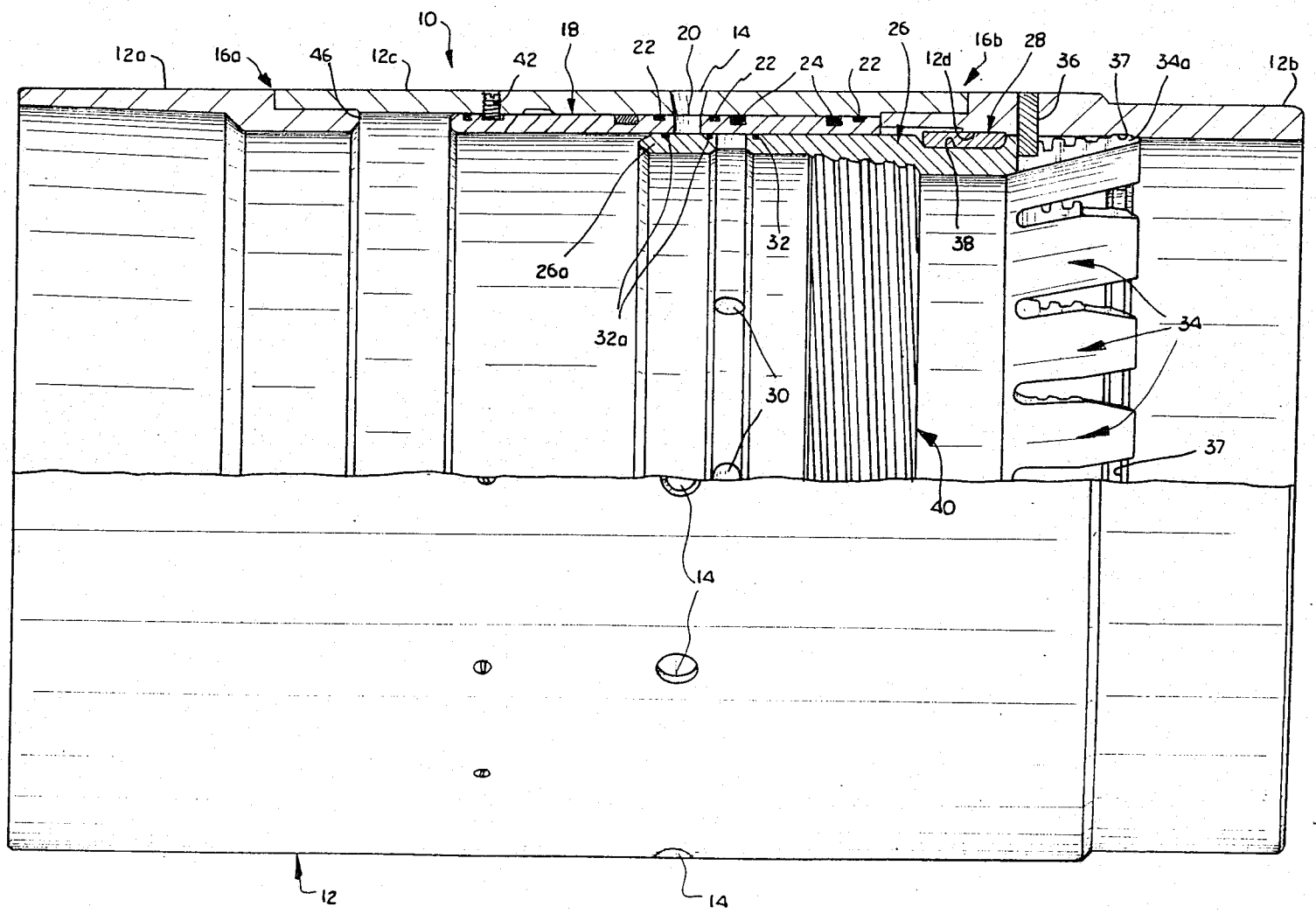
FIG. 1 is an elevational view in partial longitudinal section of a stage collar according to the present invention.

A stage collar embodying the concepts of the present invention is generally indicated by the numeral 10 in the drawings. Specifically referring to FIG. 1, the stage collar 10 includes a multisectional outer case or housing 12 which includes two end connector members 12*a* and 12*b*, respectively. The connectors 12*a*, 12*b* are adaptable for longitudinally placing the collar 10 in a well casing string "C" (not shown in FIG. 1) in a known manner.

A central portion 12*c* of the housing 12 has a plurality of ports 14 which communicate with an annulus "A" surrounding the housing 12*c* and the well casing "C" within the bore hole. The ported housing 12*c* can be joined to the connectors 12*a*, 12*b* by upper and lower scarf joints 16*a* and 16*b*, respectively.

A slidable closing sleeve 18 is sealingly mounted in the housing 12. The closing sleeve 18 includes a plurality of ports 20 which are alignable with the housing ports 14, as illustrated. The closing sleeve 18 is adapted to slide between an open position (shown in FIG. 1) and a closed position (shown in FIG. 2C). The closing sleeve 18 has a plurality of recesses for retaining sealing elements such as conventional O-rings 22 and packing 24 to provide a fluidtight seal between the adjacent faces of the sleeve 18 and the housing 12*c*.

Movement of the closing sleeve 18 is effectuated by means of a shift sleeve 26 and an expandable latch ring 28. The shift sleeve 26 includes a plurality of ports 30 which are alignable with the closing sleeve ports 20. The shift sleeve 26 is also provided with a plurality of recesses which retain sealing elements, such as O-rings 32 and 32*a*, to provide a fluidtight seal between the adjacent faces of the shift sleeve 26 and the closing sleeve 18.

The lower end of the shift sleeve 26 includes a plurality of slotted collet fingers 34 used to initially position and retain the sleeve 26 in the housing 12. A plurality of anti-rotation and guide screw lugs 36 (only one shown) are provided in the lower end connector 12*b* so as to be positioned between the collet fingers 34. The lower ends 34*a* of the fingers 34 are initially positioned unstressed and free within a corresponding groove 37 in the lower connector 12*b*. The shift sleeve 26 also has a recess 38 which cooperates with a shallow, recessed facing portion 12*d* of the lower connector 12*b* to releasably retain the latch ring 28.

FIG. 1 illustrates the relative positions of the sleeves 18,26, the ports 14, 20, 30, and the latch ring 28 during running in the hole and prior to opening the stage collar 10. The ports 30 are completely out of alignment with the aligned ports 14,20 and an upper portion 26*a* of the shift sleeve is positioned opposite the inner side of the closing sleeve ports 20 and seals off fluid communication thereto. Thus, the stage collar 10 as illustrated in FIG. 1 is in a closed run-in position. The pair of O-rings 32*a* form a fluidtight seal above and below the closing sleeve ports 20.

Figure 3:
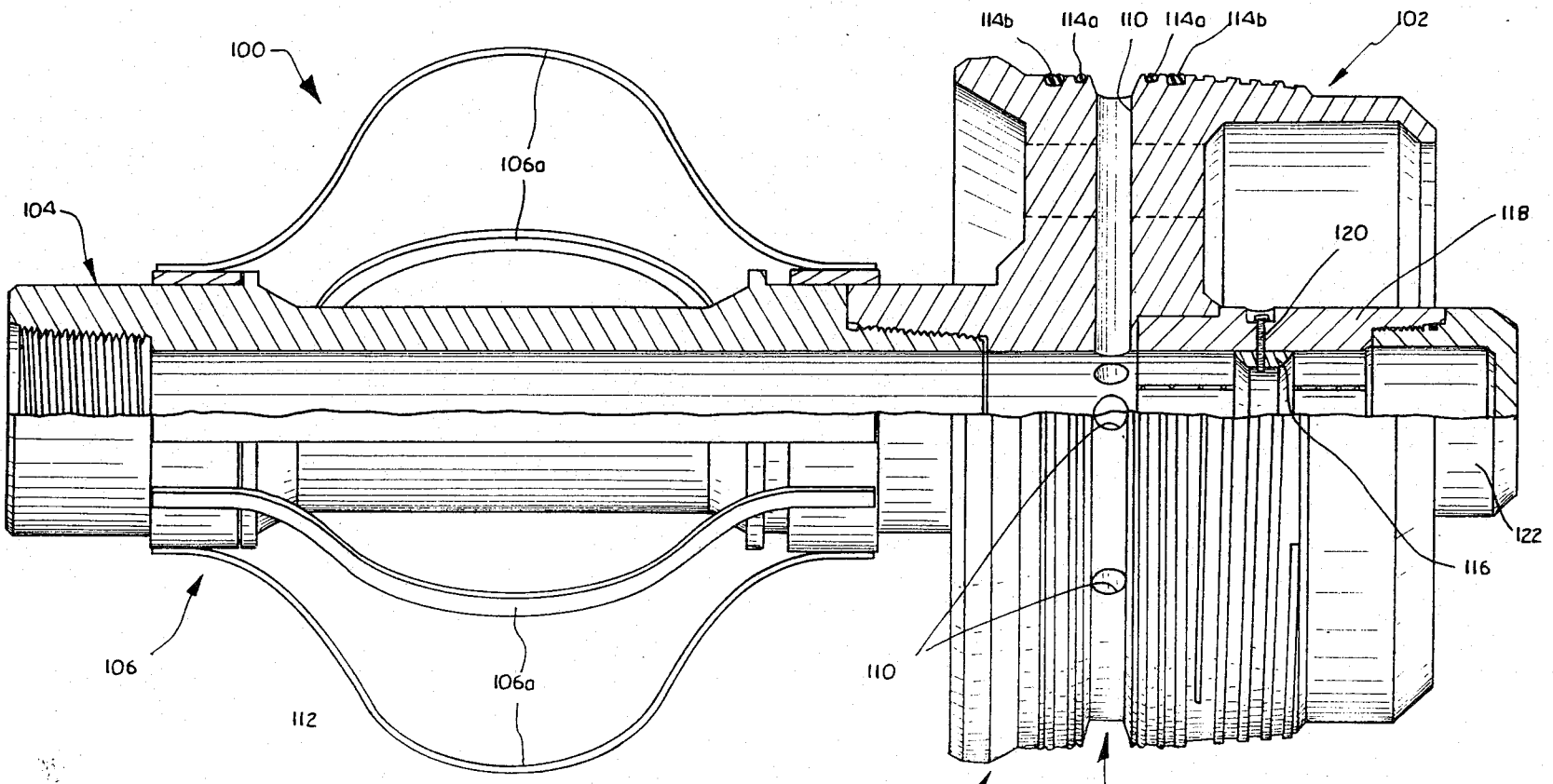
FIG. 3 is an elevational view, in partial longitudinal section, of a shifting tool according to the present invention.

The shift sleeve 26 has an inner threaded female bore 40 adapted to be threadedly engaged with a drill pipe-operated shifting tool 100 illustrated in FIG. 3. It will suffice for now to understand that the shifting tool 100 is made up with the drill pipe and is provided with a threaded male portion 102 which is screwed into the mating female bore 40 in the shift sleeve 26.

Figure 2A:
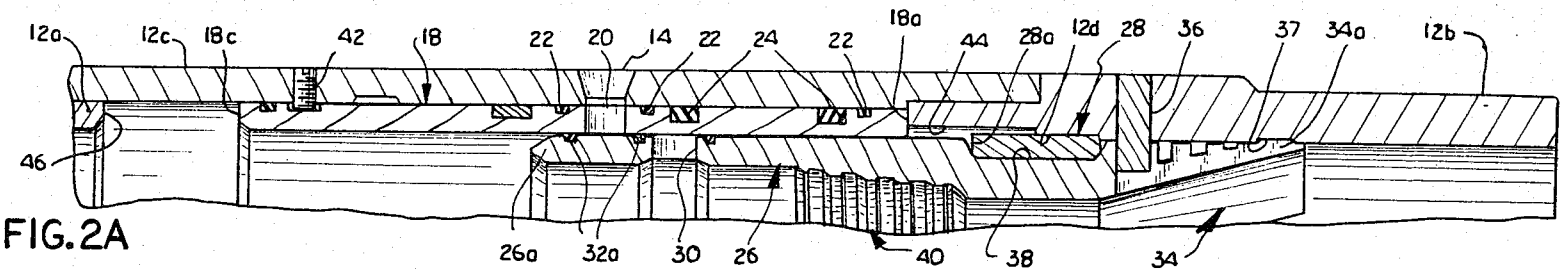
FIGS. 2A–2C are partial views of the stage collar illustrated in FIG. 1, showing relative positions of the stage collar elements during run-in, cementing and reclosure.
Figure 2B:
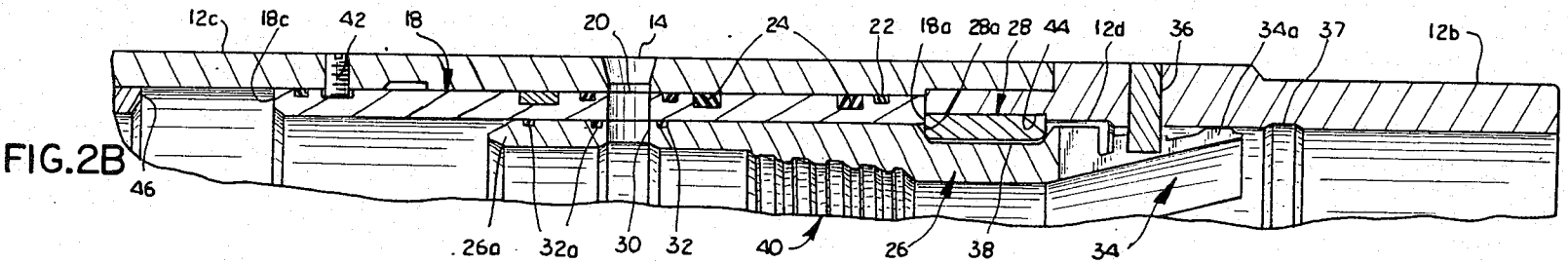
Figure 2C:
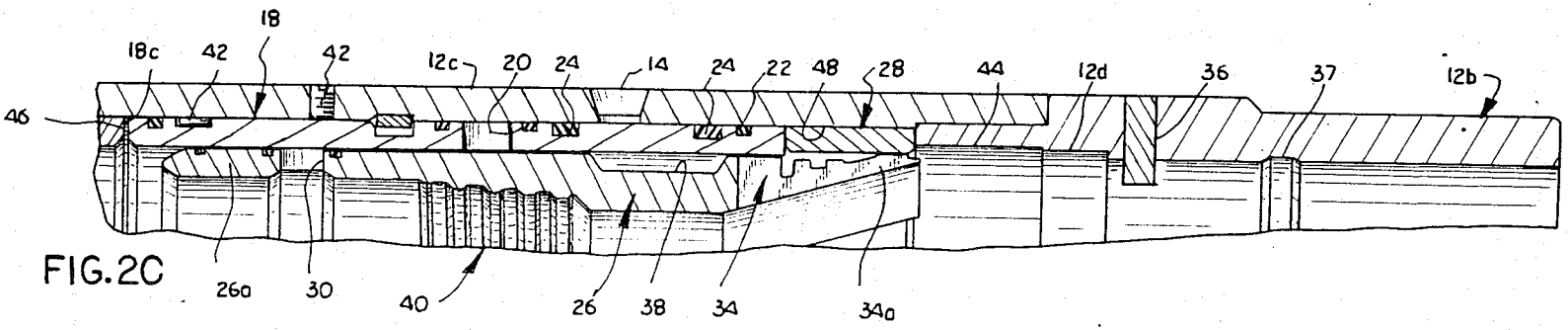

The operation of opening the stage collar 10 and then re-closing the stage collar is best shown by comparative reference to FIGS. 2A–2C. For clarity and convenience of reference, the closed run-in position shown in FIG. 1 is repeated as FIG. 2A. FIG. 2B shows the stage collar 10 in the open or cementing position and FIG. 2C shows the stage collar in the locked and closed position.

When downhole operations are completed to the point of having to open the stage collar 10 for cementing, the stab-in shifting tool 100 is engaged with the stage collar 10 by mating with the bore 40. At this point, the stage collar 10 is in the closed position, as shown in FIG. 2A (the shifting tool 100 is omitted in FIGS. 2A–2C). The drill pipe, which is connected to the shifting tool 100, is forced upwardly to exert a stage collar opening upward pull on the shift sleeve 26. Sufficient upward force is applied to cause the collet fingers 34 to move out of the grooves 37 by compressing inwardly, thus permitting the shift sleeve 26 to slide upwards. The latch ring 28, which thus far is still retained in the recess 38, also slides upwards with the shift sleeve 26.

The latch ring 28 is of a split ring design which is compressed or squeezed radially inwardly to fit within the recess 38 and held there by the opposing portion 12*d* of the lower connector 12*b*. That is, the ring 28 is compressed between the shift sleeve 26 and the connector portion 12*d*, within the recess 38.

Upward movement of the shift sleeve 26 and latch ring 28 continues until the top peripheral edge 28*a* of the latch ring engages or bumps the bottom peripheral edge 18*a* of the closing sleeve 18. This engagement will be detectable by an operator at the surface by a sudden increase in the pull load. A plurality of shear screws 42 and anti-rotation lugs (not shown) are provided to prevent the closing sleeve 18 from moving further upwards at this time, and it is necessary that the opening pull applied to the shift sleeve 26 and latch ring 28 by the drill pipe via the tool 100 not exceed the shear load of the screws 42. There are actually two anti-rotation and guide lugs (not shown) and two shear screws 42. All four elements lie in the same plane and only one of the shear screws 42 is shown in the drawings. The shear screws 42 are each threadedly mounted in the ported housing 12*c* and extend into a hole in the closing sleeve 18 as illustrated. The anti-rotation lugs do not extend into the closing sleeve 18, but are received in an axial sleeve recess in the sleeve 18 outer surface. The upward distance traveled by the drill pipe, sleeve 26, and ring 28 from the position shown in FIG. 2A to the position shown in FIG. 2B can be noted at the surface by marking the drill pipe and can be, for example, about two inches.

A recess 44 in the lower connector 12*b* captures the latch ring 28 as it moves upwardly and into engagement with the closing sleeve 18. Because the latch ring is initially compressed within the shift sleeve recess 38, the lower connector recess 44 permits the ring 28 to naturally expand outwardly and slightly away from the sleeve 26 as illustrated in FIG. 2B. The recess 44, however, is shallow or narrow enough so that the ring 28 is also still partly retained within the recess 38, and thus still operably engaged with the shift sleeve 26.

As shown in FIG. 2B, when upward movement is prevented by the latch ring 28 engaging the sleeve 18, the shift sleeve ports 30 are now aligned with the closing sleeve ports 20 which also are open to the housing ports 14. The upper end 26*a* of the sleeve 26 no longer blocks the ports 20 and the stage collar 10 is in the open or cementing position.

By way of example, in the preferred embodiment, the upward force needed to disengage the shift sleeve collet fingers 34 from the associated grooves 37 is about 10,000 to 15,000 pounds over pipe weight. The shear load of the screws 42 is a minimum of about 30,000 to 40,000 pounds over pipe weight to ensure that the procedure to open the stage collar 10 does not inadvertently break the screws 42 which would immediately reclose the collar 10.

Confirmation that the latch ring 28 has properly expanded into the recess 44 can be noted at the surface because, as illustrated in FIG. 2B, the operably engaged shift sleeve 26, latch ring 28, and lower housing connector 12*b* will prevent the drill pipe from dropping back down after the supporting load is removed. This verification, of course, is particularly effective in shallow wells. Verification can be made by marking the drill pipe with reference marks before and after the stage collar is opened.

After the cementing is completed, it is desirable to again close the stage collar 10 to optimize zone isolation. The procedure for re-closing the stage collar can best be understood by comparing FIGS. 2B and 2C.

The drill pipe is picked up and a closing load of 30,000 to 40,000 pounds over pipe weight is applied to the shift sleeve 26 via the shifting tool 100. This closing force is coupled to the closing sleeve 18 by the latch ring 28 and, upon shearing the screws 42, the closing sleeve 18, latch ring 28, and shift sleeve 26 move upwards until the top peripheral edge 18c of the closing sleeve 18 engages a lower shoulder edge 46 on the upper connector 12*a*. The latch ring 28 further expands and snaps into a gap 48 which is formed by the upward movement of the closing sleeve 18 away from the lower connector 12*a*.

After the latch ring 28 is captured in the gap 48 as illustrated in FIG. 2C, the ring 28 no longer engages the shift sleeve 26 and the shift sleeve 26 can be easily pulled out of the hole along with the shifting tool 100 and drill pipe. Furthermore, the closing sleeve ports 20 have shifted up out of alignment with the housing ports 14 and the seal elements 24,22 sealingly close off the stage collar.

The latch ring 28 can now be noted to have numerous useful features. Because the ring 28 fills in the gap 48 between the shifted closing sleeve 18 and the lower connector 12*b*, a substantially smooth and uniform inner diameter bore results in the stage collar 10 after the collar is closed without requiring any drill-out. In addition, the latch ring 28 slips in under the closing sleeve 18 and locks or latches it in the closed position. The stage collar 10 cannot be inadvertently reopened once the latch ring 28 has locked into the position shown in FIG. 2C. Also, the shift sleeve 26, shifting tool 100, and drill pipe cannot be retrieved with axial drill pipe movement until the stage collar 10 is locked closed. The latch ring 28 also provides an effective load coupling or connection between the drill pipe-actuated shift sleeve 26 and the closing sleeve 18 which permits a positive fluidtight seal to be formed between the latter two elements.

Figure 4:
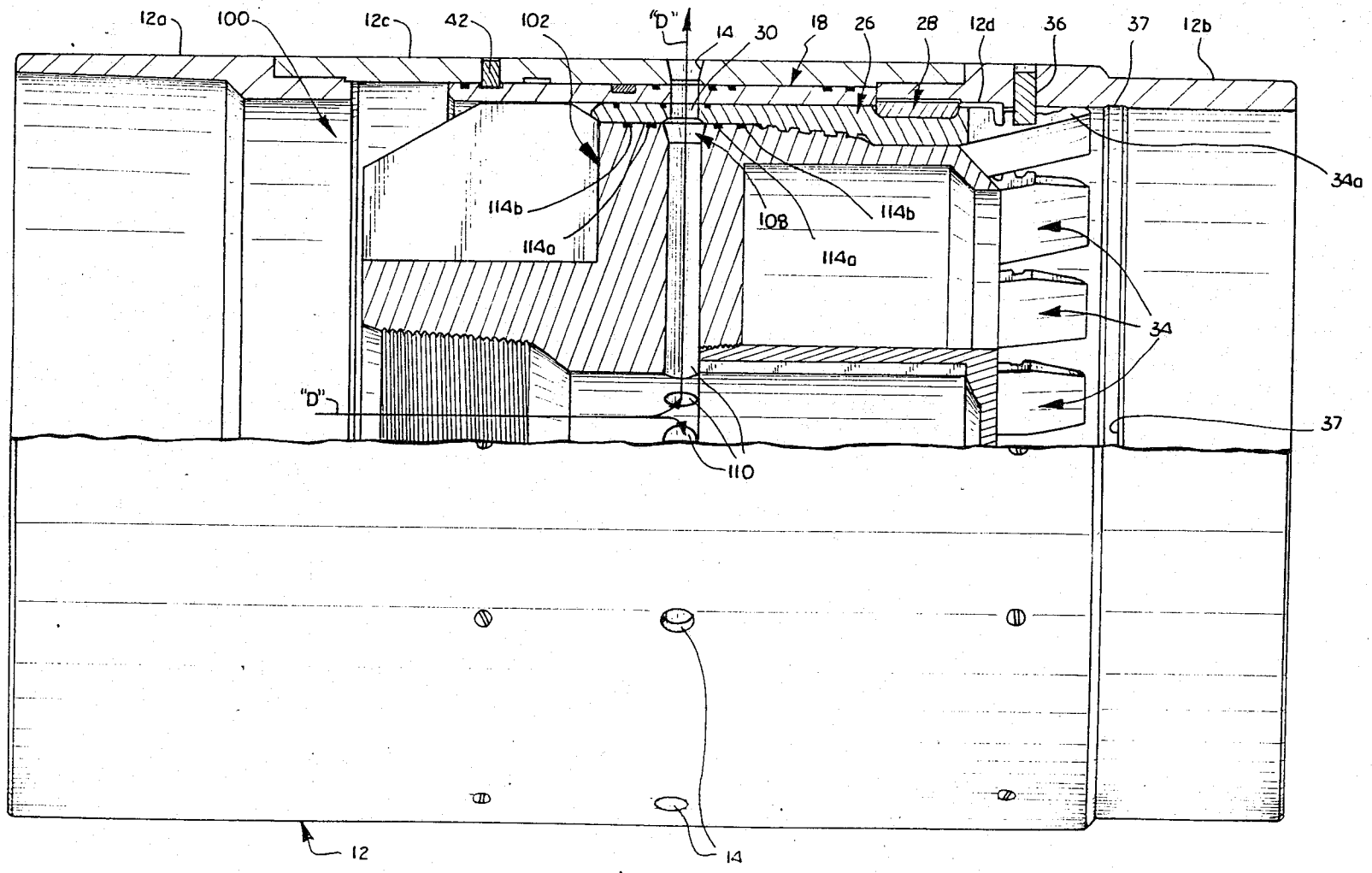
FIG. 4 is a view of the stage collar as illustrated in FIG. 2B, with the shifting tool (partially shown) installed.

With particular reference now to FIGS. 3 and 4, an embodiment of a stab-in shifting tool 100 according to the present invention will now be described. It will be recalled from the discussion hereinabove that a feature of the shifting tool 100 is the threaded male portion or seal collar 102 which is matable with the female bore 40 on the shift sleeve 26. The shifting tool 100 further includes an internally threaded centralizer sub 104 which matingly connects at its upper end to the drill pipe (not shown in FIG. 3). Mounted on the sub 104 is a centralizer assembly 106 including a plurality of centralizer bows 106*a*.

The threaded male seal collar 102 includes a circumferentially slotted manifold 108 with a plurality of ports 110 therein which open into the sub conduit 112. A plurality of circumferential O-rings and packing elements 114*a*, 114*b*, respectively, are provided above and below the ports 110 as illustrated.

A conventional plug collar 116 is supported within a plug catcher sub 118 by a plurality of shear screws 120 in a known manner. The plug catcher sub 118 is mounted on the bottom of the seal collar 102, as illustrated. A plug catcher cap 122 is threadedly mounted on the lower end of the sub 118.

Referring now to FIG. 4, when the shifting tool 100 is screwed into the shift sleeve 26, the ports 110 are open to the ports 30 in the shift sleeve 26 via the manifold 108. (The view in FIG. 4 has been simplified for clarity by omitting the drill pipe, the centralizer sub 104 and details shown in FIG. 3 not pertinent to the present discussion.) The sealing elements 114*a*, 114*b* ensure a fluidtight stab-in connection between the male seal collar 102 and the mated female bore 40. It will be noted that FIG. 4 shows the stage collar 10 in the open position (corresponding to FIG. 2B). Of course, when the shifting tool 100 is initially made up into the sleeve 26, the stage collar 10 is in the closed position shown in FIGS. 1 and 2A. Thus, after the tool 100 is initially screwed into the stage collar 10, although the tool ports 110 are aligned with the sleeve ports 30, the ports 110,30 are out of alignment with the closing sleeve and stage collar ports 20,14 when the stage collar is in the closed run-in position shown in FIG. 2A.

Still referring to FIG. 4, it can be seen that the shifting tool 100 and shift sleeve 26 cooperate to form an assembly which permits a fluidtight passage to exist between the drill pipe and the annulus "A" around the well casing and stage collar 10. Thus, cement and/or other fluids can be pumped down the drill pipe directly into the annulus "A" without entering or passing through the interior of the casing or stage collar as indicated by the flow arrow "D" in FIG. 4. This obviates the need for a well head closure device or sliding seals. The stage collar 10 and tool 100 thus act as a true stab-in apparatus by permitting fluidtight drill pipe-to-outer casing annulus displacement. The shifting tool 100 is similar to a retrievable and reusable packing tool with a positively sealed fluid passage between the drill pipe and the casing outer annulus.

An important aspect of the stab-in stage collar and shifting tool assembly just described is that the stage collar 10 can be fully operated by simple and expedient axial movements of the drill pipe, yet a fluid-tight passage from the drill pipe to the annulus is also provided by a simple axial rotation of the drill pipe (to make up the shifting tool 100 with the stage collar 10) without requiring the use of darts, plugs, sliding seal elements or hydraulic actuation. Thus, stage collar actuation is performed only with axial drill pipe movement and fluids are pumped and displaced through drill pipe. Furthermore, and still by simple drill pipe movements, the stage collar 10 can be locked closed after cementing and the shifting tool 100 and shift sleeve 26 easily removed, leaving behind a relatively smooth and uniform stage collar inner bore without drilling-out.

With particular reference to FIGS. 5A–5D, a multistage cementing operation using the stab-in stage collar and shifting tool will now be described, such description being for exemplary purposes, and should not be interpreted in a limiting sense. FIGS. 5A–5D are somewhat schematic, and reference should still be made to FIGS. 1–4 for detailed views of the stage collar and shifting tool.

Figure 5A:
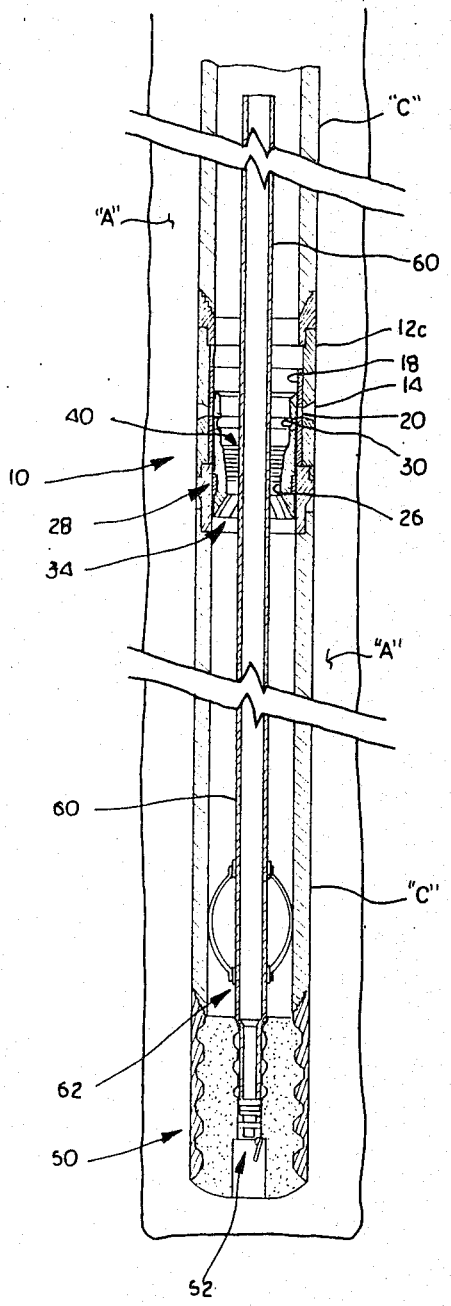
FIGS. 5A–5D show downhole illustrations of the stage collar and shifting tool shown in FIGS. 1–4 for a typical two-stage cementing operation.

FIG. 5A shows the downhole illustration just prior to the first stage cementing. Specifically, the stage collar 10 is placed in the casing "C" so that it has landed above the weak zone (not shown) and, of course, the stage collar is in the closed position as is illustrated, with the shift sleeve ports 30 out of alignment with the ports 14,20. A conventional float shoe 50 is fixedly attached to the bottom of the casing and has a common flapper valve 52 in the passage therethrough.

The drill pipe 60 with a centralizer 62 is run in the hole through the stage collar 10, and is stung into the shoe 50 in a known manner. The hole is conditioned and cement is pumped down the drill pipe 60, through the shoe 50 and into the annulus around the casing "C". The cement preferably is displaced with a conventional wiper plug 64 (FIG. 5B) and fills up the annulus "A" to the stage collar 10 and the first stage cement can in fact go above the stage collar. After the first stage cementing is completed, the drill pipe is pulled out of the shoe 50 and reverse-circulated, if necessary, to clean out the pipe 60 prior to removing it from the hole.

Figure 5B:
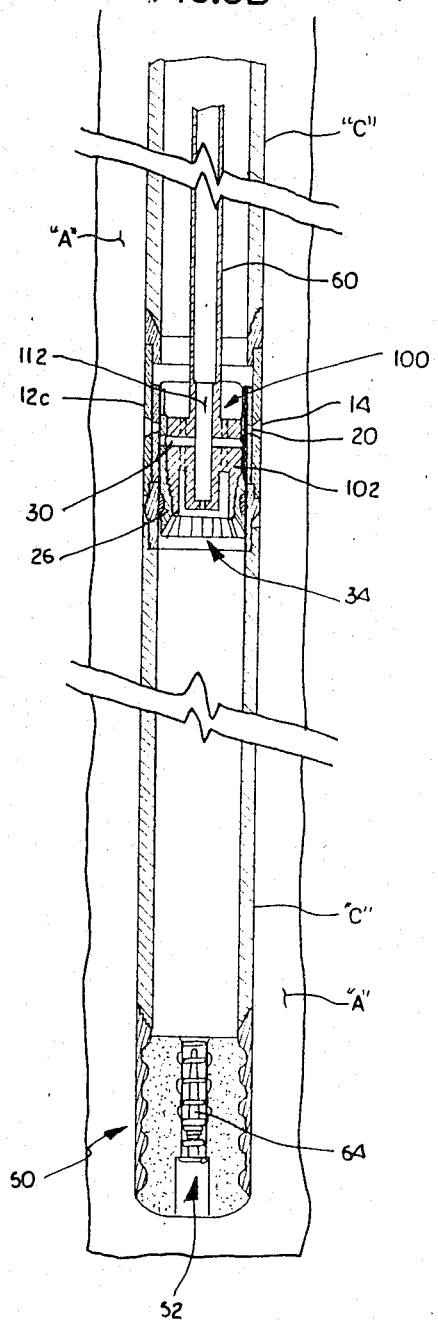

The drill pipe 60 and centralizer 62 are then removed from the hole and the shifting tool 100 is mounted on the drill pipe 60 with the centralizer 106. Drill pipe centralizers (not shown) should also be used as required. The drill pipe and shifting tool are run in the hole until the shifting tool 100 tags the stage collar 10 via the shift sleeve 26. Under a down load of, for example, 5000 pounds, the shifting tool 100 is made up with (i.e., connected to) the stage collar 10 by rotating the drill pipe 60. The tool 100 is screwed into the shift sleeve 26 with about 5 rotations until the torque builds as noted at the surface. The anti-rotation lugs 36 (FIG. 1) prevent the sleeve 26 from rotating as the tool 100 is screwed in. At this point, the shifting tool 100 is thus stabbed in the stage collar 10 as illustrated in FIG. 5B. The stage collar 10 at this point is still closed.

While in the stab-in position of FIG. 5B, the various described seals **32,32*a*,114*a*,114*b* can be tested by applying pressure to the drill pipe 60, keeping in mind that the pressure should hold because the stage collar 10 is closed and the seals 114*a*, 114*b*, 32 and 32*a* should isolate the drill pipe 60** from any annulus surrounding it.

Figure 5C:
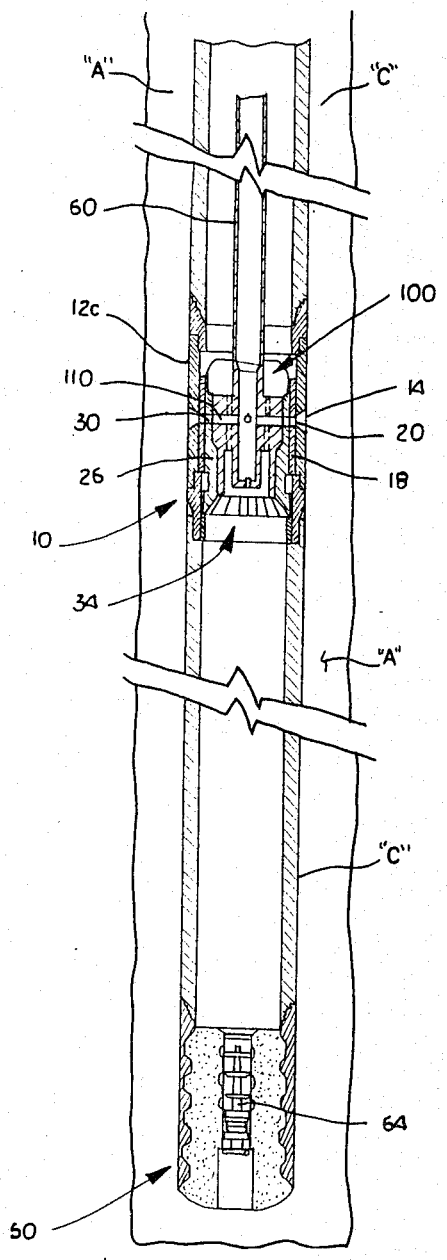

Next, the stage collar 10 is opened by pulling up on the drill pipe 10,000 to 15,000 pounds over pipe weight. The open stage collar 10, which is now in the cementing position, is shown in FIG. 5C. The upward pull of 10,000–15,000 pounds causes the shift sleeve 26 to move up until the ports 14,20 are aligned with the shift sleeve and collar ports 30,110, thus establishing direct communication between the annulus "A" and the drill pipe 60. Reference should again be made to FIGS. 2B and 4 for a more detailed view of the stage collar 10 in its cementing or open position.

The open stage collar position of FIG. 5C can, of course, be easily tested by establishing a flow rate through the drill pipe 60 to the annulus. Preferably, the stage collar 10 is opened immediately after the first stage cementing is done to simplify conditioning the hole. The hole is conditioned by pumping fluid down the drill pipe 60 and forcing the first stage cement which may have flowed above the stage collar 10 up to the surface.

After the hole is conditioned and the first stage cement has set, second stage cement is pumped down the drill pipe 60 and passes through the aligned and open ports 110, 30, 20, and 14 into the annulus. The quantity of cement displaced will depend on the particular characteristics of the bore hole, but can fill the annulus to the surface or to yet another stage collar thereabove, as would be done during a three-stage cementing operation. Again, a conventional wiper plug 66 (FIG. 5D) can be used to displace the second stage cement and sits in the plug catcher seat 16 (FIG. 3). Total displacement is indicated by a rise in drill pipe pressure, since the plug 66 will close off the drill pipe 60.

It should be noted at this time that in addition to the manifold 108 in the seal collar 102, manifold means can be provided as illustrated around the shift sleeve ports 30 and stage collar ports 14 to facilitate alignment and fluid communication between the ports. Thus, the term "alignable" when used in the instant specification and claims should be interpreted in a broader sense in that "aligned" ports are in fluid communication with each other either by direct axial alignment or by a manifold type coupling.

The stage collar 10 is then closed, as described hereinabove. The drill pipe 60 is pulled up 30,000 to 40,000 pounds over pipe weight which pulls up the shifting tool 100, shift sleeve 26, latch ring 28, and closing sleeve 18 by shearing the screws 42. This causes the ports 20 to be misaligned with the ports 14 and the latch ring 28 snaps in under the closing sleeve 18 and locks it closed. The drill pipe 60, shifting tool 100, and shift sleeve 26 then easily slip up out of the stage collar 10, leaving the collar 10 with a smooth and generally uniform bore with no need to drill out the stage collar. This is the position shown in FIG. 5D. Again, reference may be had to FIG. 2C for a more detailed view of the closed position of the stage collar.

Figure 5D:
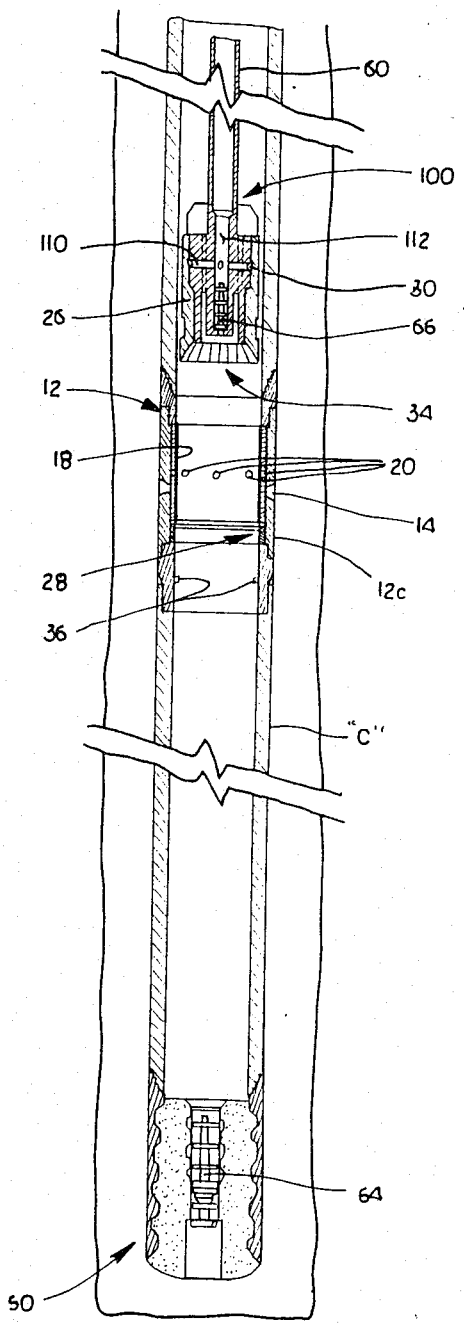

The downhole illustration shown in FIG. 5D is the second stage reverse circulation position. That is, upon closing the stage collar 10, the "wet" drill pipe 60 preferably is not pulled out of the hole. The drill pipe 60 pressure is first increased to a level adequate to shear the bolts 20 (FIG. 3), thereby forcing the plug catcher 116 and plug 66 down. This moves the plug 66 out of the way of the ports 110 and 30 (as illustrated in FIG. 5D), thus opening the drill pipe 60 to the annulus within the casing "C". Reverse circulation can then be performed to force the second stage cement waste or other fluids left in the drill pipe 60 to the surface. The "dry" drill pipe is then pulled out of the hole, with the shifting tool 100 and shift sleeve 26 attached. Further preparation of the hole for production can then proceed after drilling out the shoe 50 in a known manner.

Thus it can be understood that the stage collar 10 described herein is fully operable with only drill pipe movements and, with the shifting tool, maintains a positive seal and fluidtight passage between the drill pipe and casing annulus without entering the interior of the casing, and is locked closed after cementing, leaving behind a virtually uniform bore.

The instant invention also contemplates a new shifting tool which makes possible a two-stage cementing operation with only one run into the hole. The dual stage shifting tool which will now be described is also particularly adapted to stab-in, operate with, and actuate the stage collar 10 described hereinabove.

Figure 6:
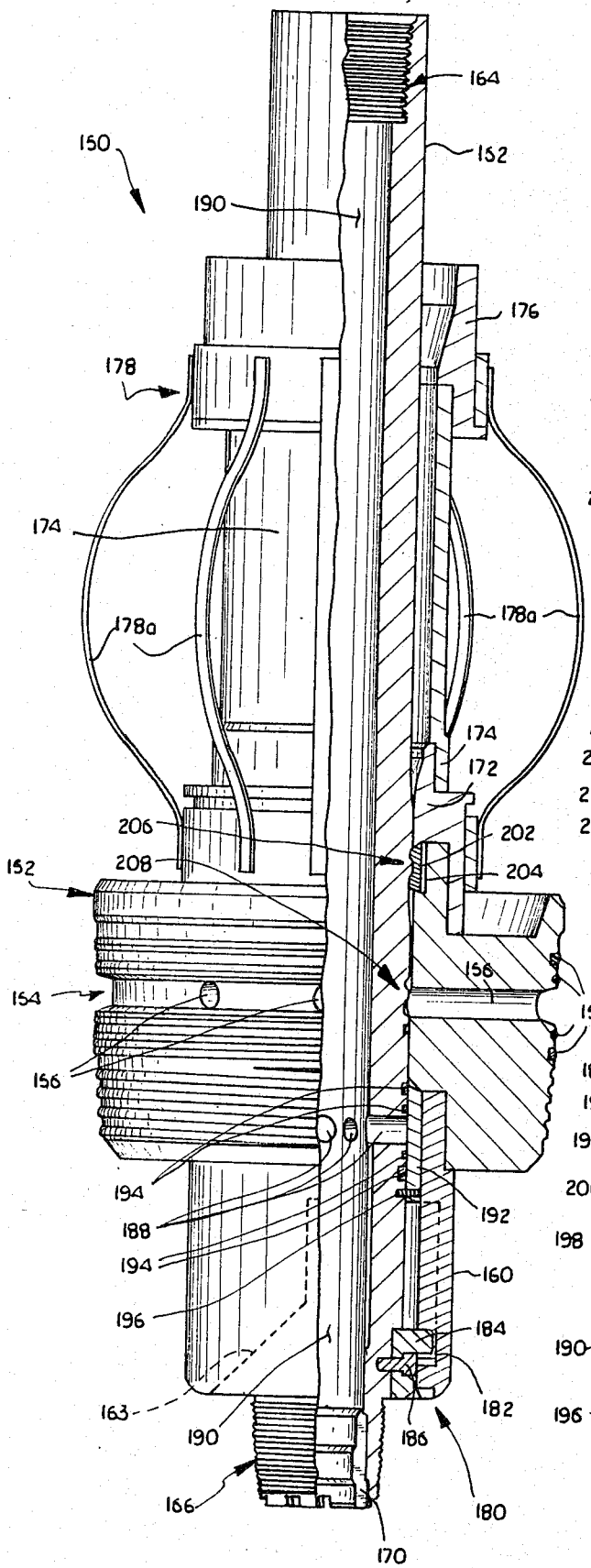
FIG. 6 is an elevational view, in partial longitudinal section, of a dual stage shifting tool particularly adapted for use with the stage collar shown in FIG. 1.

With particular reference to FIG. 6, as well as FIGS. 1 and 3, the dual stage shifting tool 150 includes a seal collar male connector 152 which can be of similar construction and function as the seal collar 102 on the shifting tool 100 shown in FIG. 3. Accordingly, the collar 152 is a threaded male element which matingly screws into the female threads on the shift sleeve 26 in the stab-in stage collar 10 (FIG. 1). The collar 152 includes a circumferentially recessed or slotted manifold portion 154 having a plurality of ports 156 therein. When the tool 150 is made up into the stage collar 10, the ports 156 align with the shift sleeve ports 30 via the manifold 154. A plurality of packing and/or O-ring type seal elements 158 are provided to form a fluidtight mated screw-in connection between the collar 152 and the shift sheeve 26.

The seal collar 152 is attached to a "J" slotted housing 160. A ported mandrel or sub 162 is slidably received within the collar 152 and the housing 160, and is adapted to axially slide therein. The mandrel 162 provides an inner threaded bore 164 which is made up with the drill pipe (not shown in FIG. 6). Thus, the drill pipe can be used to control the longitudinal position of the mandrel 162 relative to the collar 152, housing 160, and stage collar 10.

The lower end of the ported mandrel 162 has a threaded male portion 166 adapted to matingly connect with a conventional drill pipe stinger extension 168 (shown schematically in FIGS. 7A–7F). The bottom inner bore of the mandrel 162 has a conventional dart seat 170 therein.

The top end of the seal collar 152 is attached to a lower centralizer bushing 172. A centralizer tie sleeve 174 fixedly joins, in a spaced-apart arrangement, the lower bushing 172 and an upper centralizer bushing 176. The upper and lower centralizer bushings 172, 176 provide a means for mounting a centralizer 178 on the tool 150 while permitting the ported mandrel 162 to be axially slidable therein. The centralizer 178 includes a plurality of centralizer bows 178*a*.

The ported mandrel 162 is releasably coupled to the housing 160 by means of a "J" slot and lug mechanism 180. The housing 160 includes a "J" slot 182 which captures a "J" lug collar 184 when the lug collar is positioned as shown in FIG. 6. The J-lug 184 is fixedly mounted on the ported mandrel 162 by a bolt 186. When the lug 184 is captured in the housing J-slot 182, the mandrel 162 is axially fixed with respect to the collar 152 and the housing 160. A simple one-quarter rotational turn imparted to the drill pipe will in turn rotate the mandrel 162 and uncapture or unseat the J-lug collar 184 from the J-slot 182. This permits the ported mandrel 162 to telescopically extend out of the tool 150 by sliding axially down through the collar 152 under control of the drill pipe. After extension, the ported mandrel 162 can be pulled up and back into the housing and collar 160, 152 by simply picking up the drill pipe. During such retraction, the J-lug collar 184 is guided back into the housing 160 by a funneled passage 163 in the housing 160.

The tool 150 is designed so that a counterclockwise series of rotations (about five) is used to screw the tool 150 into the stage collar 10. Thus, the "J" mechanism is designed to disengage with a one-quarter clockwise turn so that the tool 150 can be made up into the stage collar 10 without inadvertently "unjaying" the ported mandrel 162. It should now be clear that the position of the shifting tool 150 shown in FIG. 6 is the closed run-in position and also is the position when the tool is initially made up into the stage collar 10.

The mandrel 162 includes a plurality of ports 188 which are alignable with the collar ports 156 and provide fluid communication between the collar 152 and a central bore 190 of the ported mandrel 162. As shown in FIG. 6, during running in and during the first stage cementing operation the mandrel ports 188 are out of alignment with the ports 156 and are maintained closed by a port closure sleeve 192. Thus, the shifting tool 150 is depicted in FIG. 6 in a closed position. This permits cement and fluids to be pumped down the drill pipe and through the ported mandrel bore 190 during the first stage cementing without loss of fluid through the ports 188. A plurality of packing and seal elements 194 form a fluidtight seal above and below the ports 188 against the sleeve 192. The sleeve 192 is fixedly joined to the mandrel 162 by shear bolts 196 (only one shown) so that the sleeve 192 travels with the mandrel 162 and maintains the ports 188 closed as the mandrel telescopically slides down and out of the housing 160.

The procedure for opening the dual stage shifting tool 150 to the stage collar 10 will now be described, and reference should be made to FIGS. 6 and 6A. As with the above-described shifting tool 100, the dual stage shifting tool 150 is run into the hole and made up into the stage collar 10 by a series of counterclockwise turns which screw the collar 152 into the shift sleeve 26. The shifting tool 150 and stage collar 10 at this time are closed (although the mandrel 162 is telescopically extended down for the first stage cementing operation). After the first stage cementing operation is completed, the ported mandrel 162 is pulled back up into the tool 150 by the drill pipe. As the mandrel 162 telescopes up into the collar 152 and housing 160, a top peripheral edge 198 of the closure sleeve 192 engages a recessed shoulder 200 on the collar 152. This engagement prevents further upward movement of the sleeve 192, and when a predeterminable force is applied to the drill pipe, the shear bolts 196 will shear off (see FIG. 6A).

The ported mandrel 162 is then free to move further upward while the closure sleeve remains in the housing 160, thereby opening the mandrel ports 188.

Figure 6A:
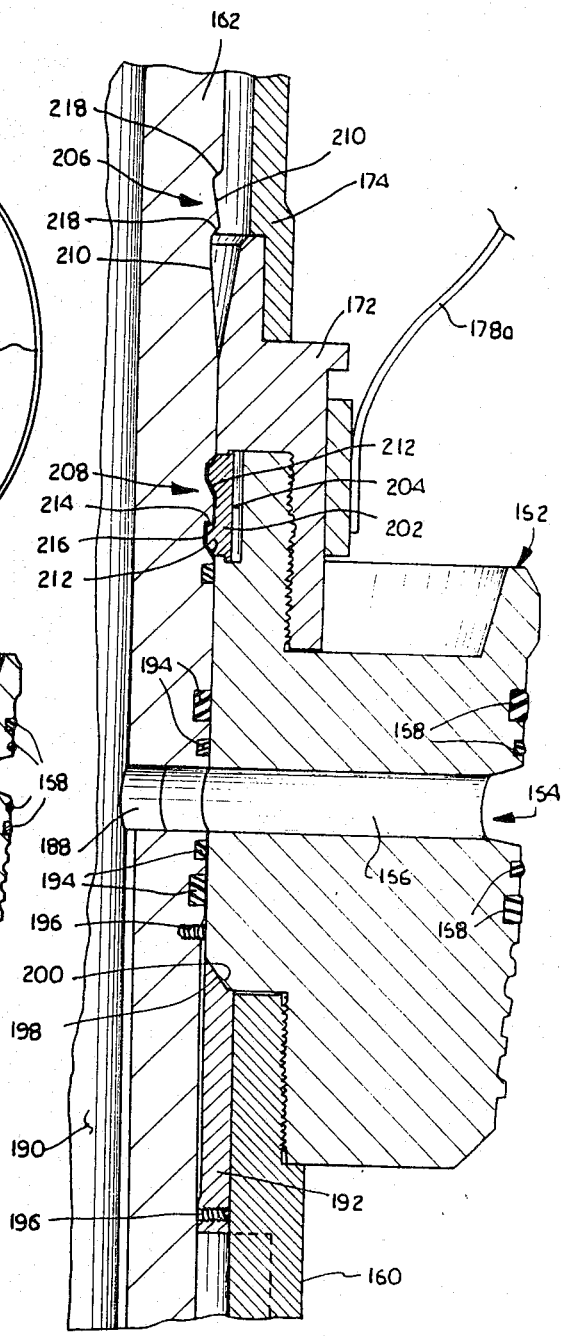
FIG. 6A is an enlarged view of a portion of the dual stage shifting tool shown in FIG. 6, specifically showing the shifting tool ports in an open position.

The ported mandrel 162 is raised until the ports 188 are aligned with the collar ports 156 such that the tool 150 is now open, as depicted in FIG. 6A. A collapsibly biased mandrel latch ring 202 is retained between the collar 152 and the mandrel 162 in a small recess 204 in the collar 152. The ring 202 is trapped in the recess 204 by a lower facing portion of the bushing 172. As best shown in FIG. 6A, the ported mandrel 162 has an upper detent 206 and a lower detent 208. The upper detent 206 is positioned so as to capture a radially inner portion of the latch ring 202 when the dual stage shifting tool 150 is in the closed position (FIG. 6). The ring 202 and upper detent 206 provide a position indicating means detectable at the surface as a resistance to upward movement of the drill pipe. During initial assembly of the tool 150, the upper detent 206 provides a position locater to indicate that the tool 150 is in the closed position. The detent 206 has cam surfaces 210 which cammingly engage corresponding surfaces 212 on the latch ring 202. The camming action expands the ring 202 radially outwardly as the mandrel 162 is pulled upward, thus disengaging or releasing the ring 202 from the detent 206 when sufficient force is applied. As the mandrel 162 continues to be raised, the lower detent 208 is positioned so as to capture the latch ring 202 when the shifting tool 150 is in the open position, i.e., the ports 156 and 188 are aligned. This is the position shown in FIG. 6A.

It will be noted that the lower detent 208 has a different contour from the upper detent 206. The lower detent 208 has a radial shoulder 214 which slips over and engages a corresponding radial shoulder 216 on the latch ring 202. Once this engagement is made, the ring 202 is captured and the mandrel 162 cannot be telescopically lowered with respect to the collar 152 and is supported therein. This provides a means for detecting at the surface that the shifting tool 150 has been opened. By setting down the drill pipe, the drill pipe should not lower without supporting weight if the ring 202 is properly captured in the lower detent 208 and the tool 150 is open. Simply applying pressure to the drill pipe to check that the ports 156, 188 are aligned would not provide an indication because at this time the stage collar 10 is still closed.

As shown in FIG. 6A, the packing and seal elements 194 form a fluidtight seal between the ported mandrel 162 and the collar 152, thereby ensuring a fluid-tight passage from the drill pipe, through the shifting tool 150 and stage collar 10, and into the annulus around the casing without entering the interior of the casing. It will be recalled that this feature is also provided on the earlier-described shifting tool 100. It should also be noted that the shifting tool 150 is fully actuable by simple drill pipe movements, as is the stage collar 10.

Referring still to FIG. 6A, it will be noted that the mandrel latch ring 202 is T-shaped in section, as is the recess 204 formed by the busing 172 and seal collar 152 in which the ring is retained. This design permits the collapsible ring 202 to be expanded and to thus move radially in and out so as to engage and disengage with the detents 206,208, yet prevents the ring 202 from totally collapsing or falling out of the recess 204 whenever the mandrel or drill pipe are not within the collar 152, such as during initial installation. The upper detent 206 also has second cam surfaces 218 which expand the ring 202 when the mandrel 162 is pushed down via the drill pipe. This downward movement occurs, for example, during stab-in of the float shoe 50 prior to the first stage cementing operation.

The upper detent 206 and ring 202 thus coact as a backup and prevent inadvertent decoupling of the mandrel 162 from the collar 152 should the "J" mechanism 180 disengage while running in the hole, and also prevents the drill pipe and mandrel 162 from suddenly dropping when the mandrel 162 is "unjayed" from the housing 160.

With particular reference to FIGS. 7A-7F, an exemplary two-stage cementing operation involving only one run down the hole by using the dual stage shifting tool 150 will now be described. Elements in FIGS. 7A-7F which correspond to elements in FIGS. 5A-5D are given the same numeral.

Figure 7A:
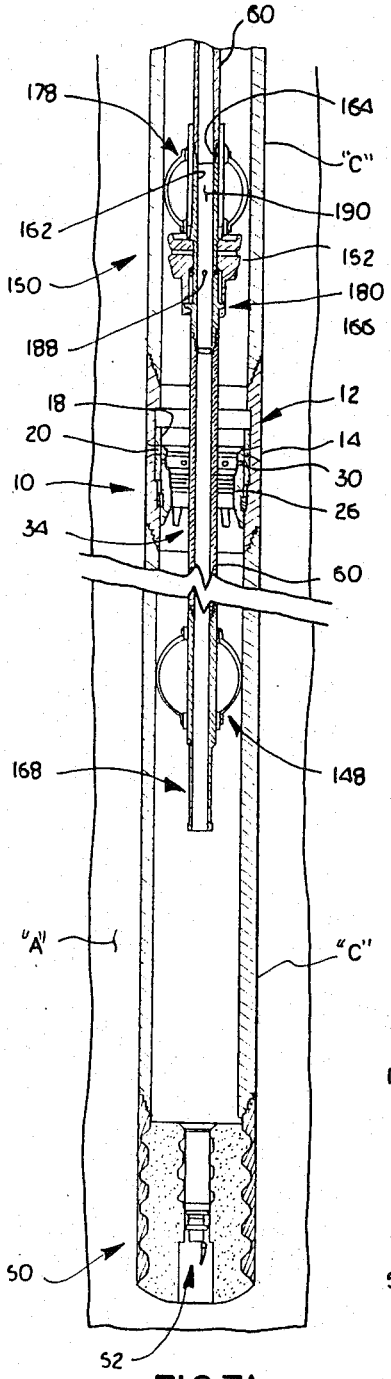
FIGS. 7A–7E show downhole illustrations of the stage collar and dual stage shifting tool shown in FIGS. 1 and 6 for a two-stage cementing operation involving only a single run down the hole.

FIG. 7A shows the downhole illustration during running-in. The stage collar 10 has been placed in the casing "C" so as to land at a predeterminable location such as above a weak zone (not shown). The conventional cementing shoe 50, of course, is positioned at the bottom of the casing. The shoe stab-in tool 168 may be of conventional design and is carried on the lower end of the drill pipe below the dual stage shifting tool 150. A centralizer 148 is mounted on the stab-in tool 168 in a known manner. In order to ensure that the shifting tool 150 can be made up into the stage collar 10, the tool 150 is placed in the drill pipe 60 so that the length of the drill pipe between the bottom of the stab-in tool 168 and the shifting tool 150 is ten to sixty feet less than the distance between the shoe 50 and the stage collar 10. That is, first the conventional stab-in tool 168 is made up to the drill pipe with the centralizer 148, and then followed with drill pipe 60 until the length of the drill pipe is ten to sixty feet less than the distance between the shoe 50 and the stage collar 10. Then the shifting tool 150 is made up in the drill pipe via the threaded male end 166 on the ported mandrel 162 (see FIG. 6). This procedure ensures that the shifting tool 150 can be made up with the stage collar 10 before the conventional stab-in tool 168 can tag the shoe 50.

The centralizer 178 is next made up in the drill pipe and the "J" mechanism 180 can be checked to verify that it is properly engaged. The drill pipe 60 is then run in at a moderate rate, having been joined to the shifting tool 150 via the threaded connector 164 on the top of the ported mandrel 162. During running-in, rotation of the drill pipe should be avoided to prevent accidentally unjaying the ported mandrel 162 from the "J" housing 160. During running-in, of course, the conventional stab-in tool 168 is appropriately sized to easily pass through the stage collar 10, as shown in FIG. 7A.

Figure 7B:
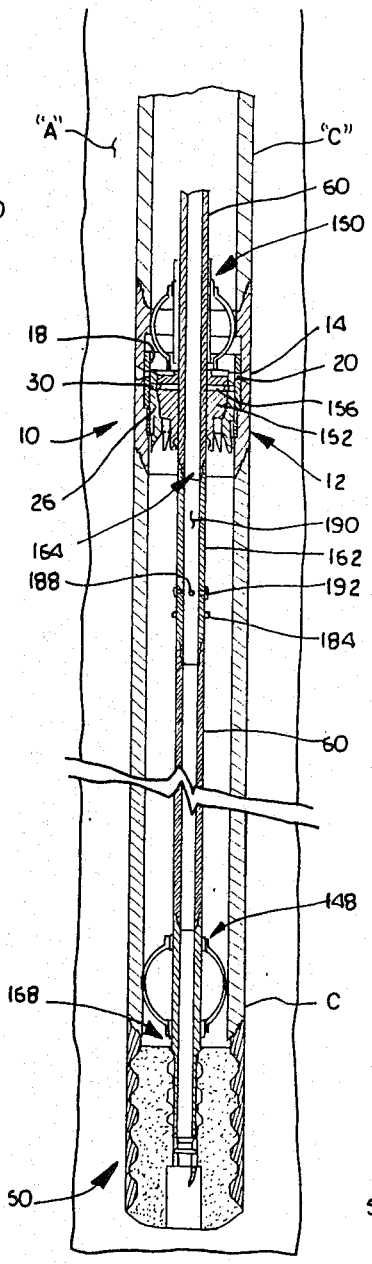
Figure 7C:
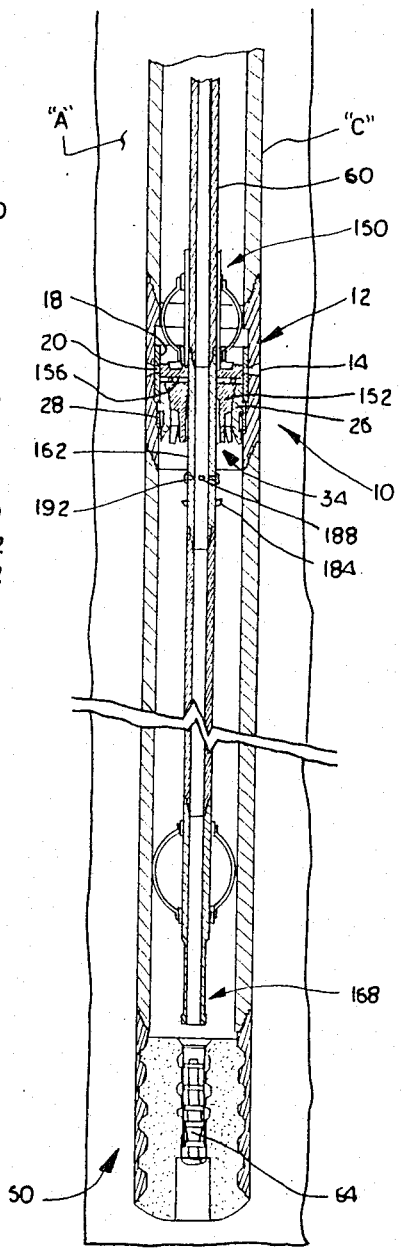

After slowing down as the stage collar 10 is reached, the dual stage shifting tool 150 lightly tags the stage collar 10 and the drill pipe can be marked for a positional reference. The drill pipe 60 is rotated counterclockwise while maintaining a load of about 2,000 to 10,000 pounds on the tool 150. About 4 or 5 revoltuions will make up the tool 150 in the stage collar shift sleeve 26 (FIG. 1), and rotation is continued until the torque builds to about 2000 foot/pounds. The shifting tool 150 is now connected to the stage collar 10 as shown in FIG. 7B. The tool 150 is still closed, however, as described hereinbefore because the ports 188 are sealed by the closure sleeve 192. The pipe 60 is again marked and the first and second positional reference marks should be about three inches apart. The seals and packing elements 22, 24, 32 and 32*a* which seal the stage collar 10 closed can be checked at this time by applying pressure down the casing side. The stage collar 10, of course, is also still closed in that the ports 14,20 are not aligned with the shift sleeve ports 30.

The counterclockwise torque is released and the ported mandrel 162 is unjayed from the tool 150 by a slight clockwise rotation to disengage the J-lug collar 184 from the J-slot 182 in the housing 160. This permits the drill pipe 60, the ported mandrel 162, and the stab-in tool 168 to be lowered ten to sixty feet to fluidtightly sting the tool 168 into the shoe 50. This is the first stage cementing position shown in FIG. 7B. Note that the ported mandrel ports 188 are still closed by the sleeve 192 so that the drill pipe 60, mandrel 162, and tool 168 from a fluidtight conduit down to the shoe 50. It should also be noted that the drill pipe 60, mandrel 162, and tool 168 form a rigid string from the surface to the shoe 50 to provide a positive sting-in verification of the surface.

The first stage cementing operation is then performed via the shoe 50 as described hereinbefore. The cement is displaced with the conventional wiper plug 64. (FIG. 7C), after which the flapper check valve 52 is closed. The drill pipe 60 is next picked up and the stab-in tool 168 is released up from the shoe 50 about five feet to permit reverse-circulating the drill pipe 60, if necessary. This is the downhole position shown in FIG. 7C.

A second stage shut-off dart 146 can be dropped at this time, and will land in the dart seat 170 (FIG. 6). The dart 146 can be pressure-tested by applying 1500 psi down the drill pipe 60. Then the drill pipe 60 is picked up and the ported mandrel 162 is pulled back into the stage collar 10. (More specifically, of course, the mandrel 162 is telescopically retracted back into the collar 152 and housing 160 as in FIGS. 6 and 6A.)

The drill pipe 60 is pulled up with about 2,000 to 5,000 pounds, thus shearing off the screws 196 so that the lower detent 208 captures the mandrel latch ring 202 as described earlier herein. This is the position shown in FIG. 7D and reference should be made to FIG. 6A for greater detail. Verification can be made at the surface in that the second reference mark on the drill pipe 60 should be one to two inches higher than its original position (which would be about the lineal distance between the upper and lower detents 206,208). Also, the drill pipe 60 should not lower without supporting weight because the mandrel 162 should be latched by the ring 202, as previously described.

Figure 7D:
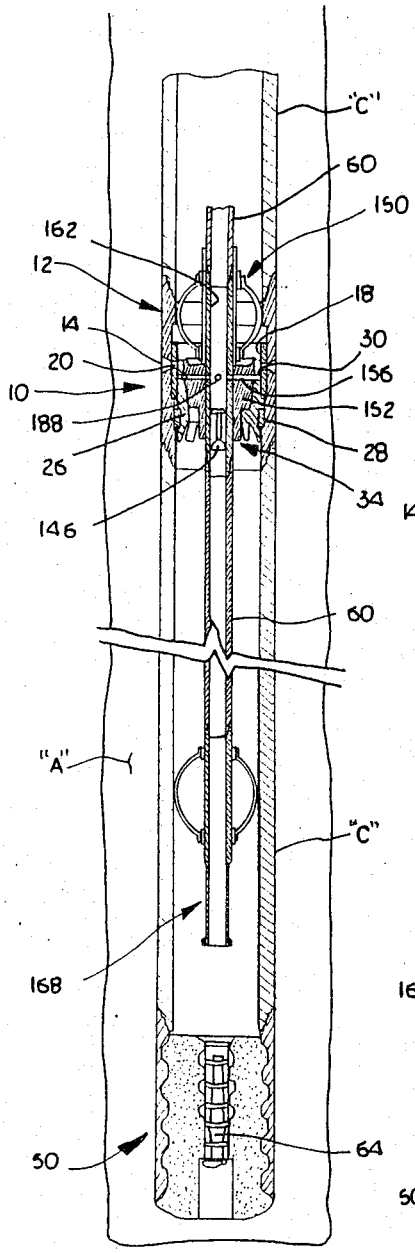
Figure 7E:
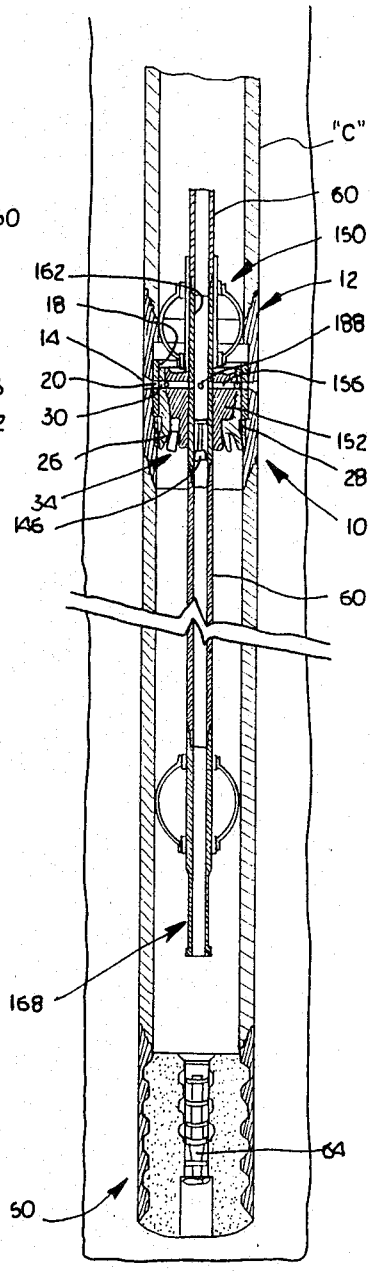

As shown in FIG. 7D, the dual stage shifting tool 150 is now open because the mandrel ports 188 are aligned with the collar ports 156, and both are aligned with the shift sleeve ports 30. The stage collar 10, however, is still closed because the shift sleeve 26 is still in its down position (see FIG. 2A). At this time, the seals 158, 194 and 32 can be checked by pressure-testing the drill pipe 60.

From this point on, the operation of the dual stage shifting tool 150 and stage collar 10 is essentially the same as described hereinabove with the shifting tool 100. A pull-up on the drill pipe 60 of about 10,000 to 15,000 pounds over pipe weight opens the stage collar 10 by sliding the shift sleeve 26 up until the latch ring 28 is captured in the recess 44 (FIG. 2B). The second reference mark on the drill pipe 60 should now be two to three inches above its original position, and should not drop down. This is the position shown in FIG. 7E. Note that the ports 14, 20, 30, 156, and 188 are now all aligned and in fluid communication with each other and form a fluidtight passage from the drill pipe 60 to the annulus "A" around the casing "C".

It is important to note at this time that the dual stage shifting tool 150 has the very desirable feature that it is fully actuated (stab-in and opened) by simple drill pipe movement, as is the stage collar 10. A positively sealed passage is also provided between the drill pipe and casing annulus.

The hole is now conditioned as described hereinabove and the second stage cement is pumped and displaced by a wiper plug 144. The drill pipe 60 is then pulled up 30,000 to 40,000 pounds over pipe weight to close the stage collar 10, as described hereinbefore (refer to FIG. 2C and the discussion related thereto for details). The ports 14 and 20 are now misaligned and the stage collar 10 is locked closed by the latch ring 28. This is the stage collar position shown in FIG. 7F.

When a two-stage cementing operation is being performed in the hole, the dual stage shifting tool 150, shift sleeve 26, and stab-in tool 168 can then be easily removed and the stage collar 10 is left with a substantially smooth and uniform bore and is locked closed (see FIG. 2C). The dual stage shifting tool 150 and stage collar 10 thus permit a true drill pipe-actuated, multi-stage cementing system with all the advantageous features described hereinbefore without the need for hydraulic actuation or drill-out. It should also be noted that the dual stage tool 150 obviates any need for slip joints or length compensation in the drill pipe between the stage collar 10 and the shoe 50. The drill pipe is simply lowered down and stung into the shoe 50 to perform the first stage cementing after the tool 150 has been made up into the stage collar 10.

Figure 7F:
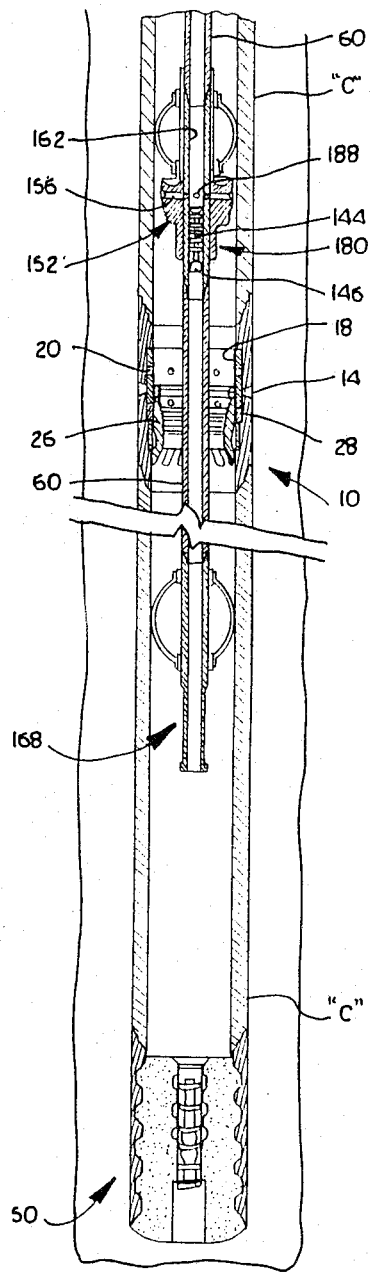
FIG. 7F shows a downhole illustration of the stage collar and dual stage shifting tool during a three-stage cementing operation.

The dual stage shifting tool 150 and stage collar 10 can also be used to perform a three-stage cementing operation (FIG. 7F). In such a case, there will be an upper stage collar (not illustrated) and a lower stage collar. The collars can be of a construction similar to that of the stage collar 10 described herein, although the upper stage collar will have a larger inner diameter with respect to the lower stage collar. At the completion of the second stage, however, the lower stage collar shift sleeve 26 will have to remain in the lower stage collar in order to permit the shifting tool 150 to be retrieved up through the upper stage collar. To accomplish this, all that is required is that after the lower stage collar 10 is closed in the described manner, the drill pipe 60 is lowered so as to push the shift sleeve 26 back down to tag the anti-rotation lugs 36 (refer back to FIG. 1). This downward movement cannot reopen the stage collar 10 because the latch ring 28 has locked the stage collar closed and the ring 28 is completely disengaged from the shift sleeve 26. Once the lugs 36 are tagged, the shifting tool 150 can be clockwise-rotated back out of the sleeve 26 and raised out of the stage collar 10. This is the position shown in FIG. 7F. The ports 156 can be reopened by pressurizing the drill pipe to push down the dart 144. The open ports 156 permit reverse circulation if necessary. It will be noted that the shift sleeve 26 remains in the lower stage collar 10 but is made of a drillable material, for example, aluminum. The shifting tool 150 can then be pulled out of the hole through the upper stage collar. The third stage cementing is then performed using the upper stage collar and another shifting tool such as the tool 100 described hereinabove. The upper stage collar, of course, will be left with a smooth and generally uniform bore without drilling-out as described hereinbefore. The upper stage collar requires a slightly larger minimum inner diameter than the lower stage collar minimum inner diameter to permit retrieval of the dual stage shifting tool 150.

Referring once again to FIGS. 2A-2C, it will be recalled that the stab-in stage collar 10 is both opened and locked closed by an upward pull on the shift sleeve 26 via the drill pipe 60 and the shifting tool 100 or dual stage shifting tool 150. In certain situations, such as in offshore drilling operation, it is desirable that a downward movement of the sleeve 26 be used to open the stage collar 10. The design of the stage collar easily accommodates this usage with simple modifications.

Figure 8A:
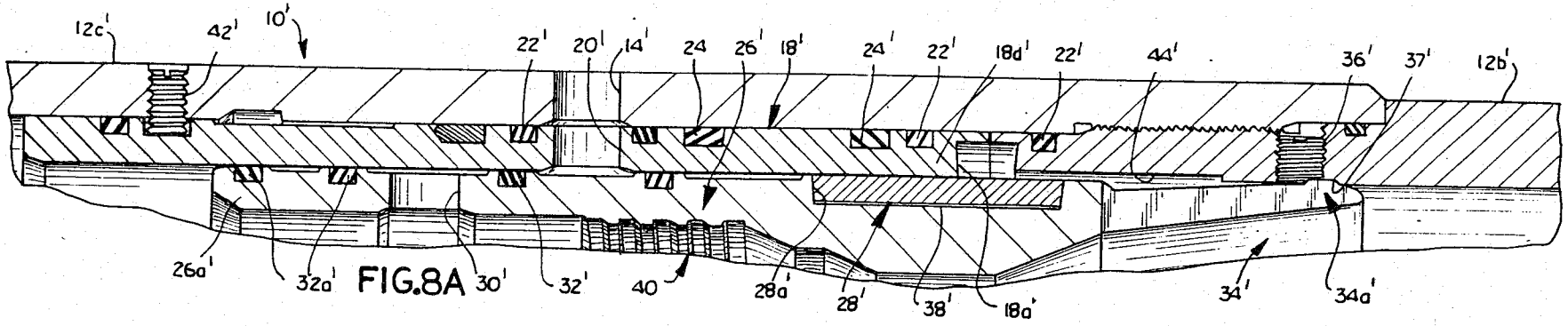
FIGS. 8A–8C show another embodiment of a stage collar according to the present invention wherein a downward movement is used to open the stage collar.
Figure 8B:
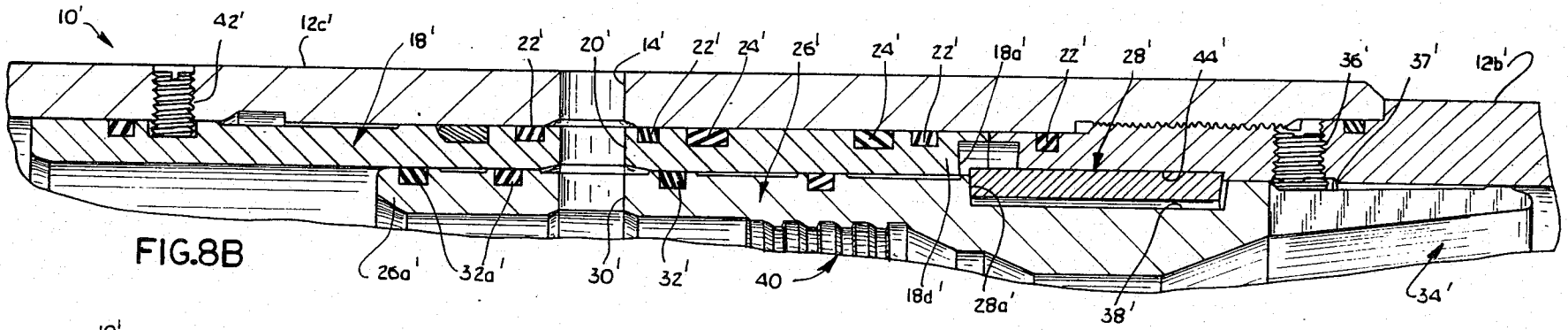
Figure 8C:
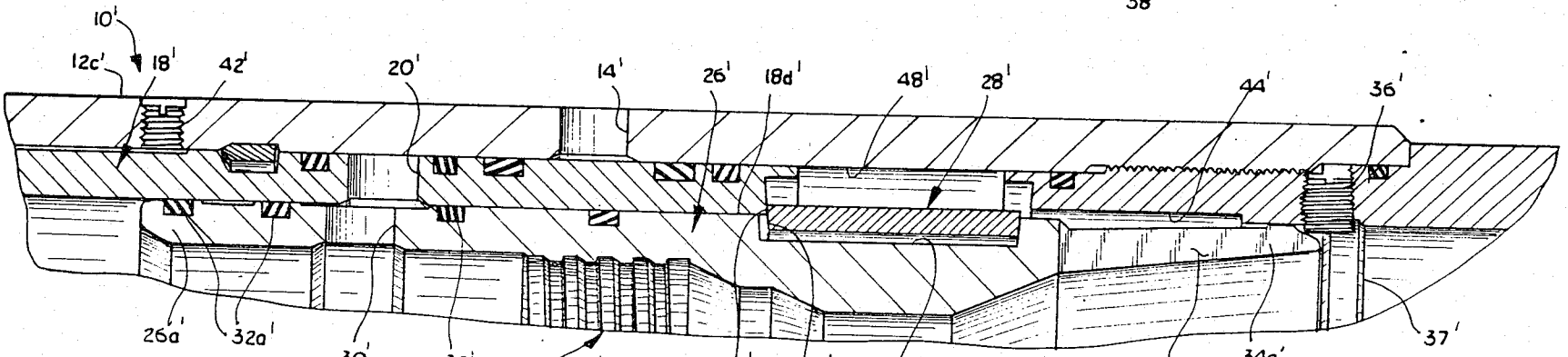

In such a case as illustrated in FIGS. 8A-8C (corresponding elements with FIGS. 2A-2C are given the same numeral followed by a prime (')), the collet fingers 34' still initially engage the collet groove 37'. Note that the collet groove 37' is now positioned in the lower connector **12*b*' nearer the anti-rotation lugs 36'. The shift sleeve 26', therefore, is initially positioned higher in the stage collar 10' so that the shift sleeve ports 30' are initially positioned out of alignment with and above the ports 14',20' as illustrated. The recess 38' and latch ring 28' are likewise initially positioned above the recess 44' so that downward movement of the sleeve 26' pushes the collet fingers 34' down and out of the groove 37' and also pushes the latch ring 28' down. The ring 28' is then captured in the recess 44' as before by expanding slightly outwardly and the ports 30' are aligned with the ports 14',20' and the stage collar 10' is thus opened. This is the cementing position shown in FIG. 8B. Closing of the stage collar 10' is performed as before by an upward pull sufficient to shear the screws 42' (not shown in FIGS. 8A-8C) to permit the closing sleeve 18' to move up to the locked closed position as illustrated in FIG. 8C. It will be noted in FIGS. 8A-8C that an inner portion 18*d*' of the closing sleeve 18' extends radially inwardly and provides a shoulder 18*a*' against which the latch ring 28' pushes in order to close the stage collar 10' (compare FIGS. 8B and 8C). Also note that FIG. 8C illustrates the stage collar 10' just at the time when the latch ring 18' is about to snap into the gap 48' formed when the closing sleeve 18'** moved upwards to its closed position.

Figure 9C:
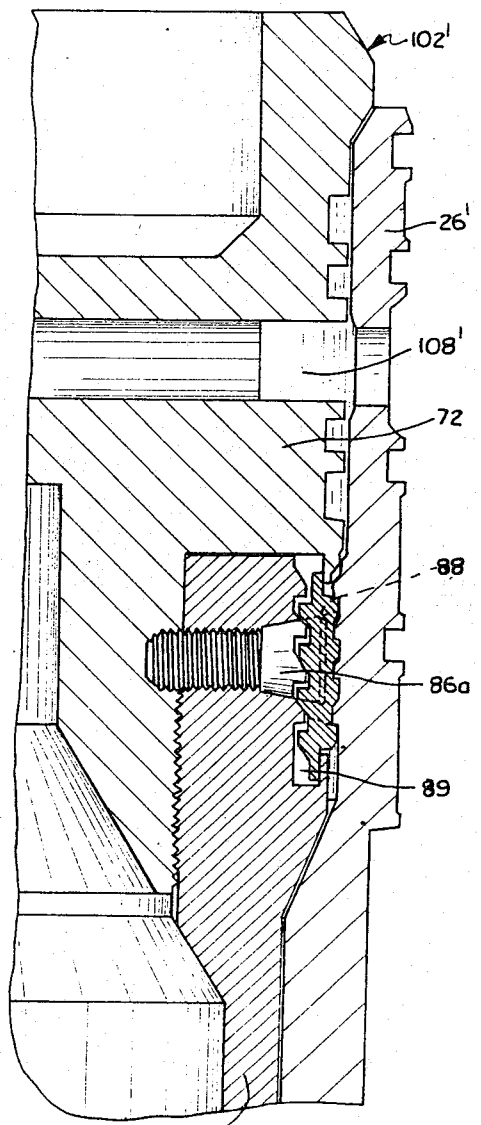
FIGS. 9A–9C show an embodiment of a means for latching a shifting tool in the stage collar without a threaded engagement.
Figure 9B:
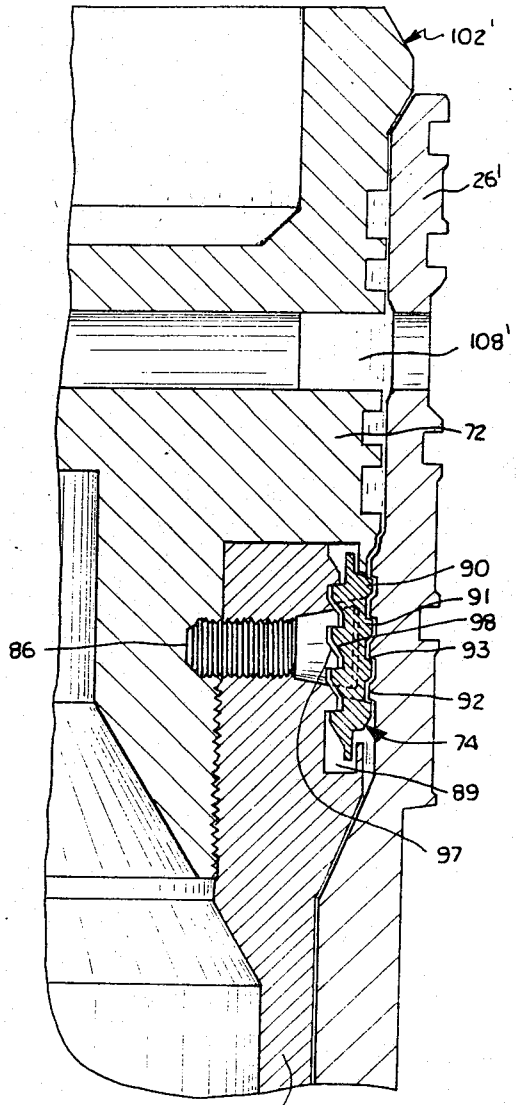
Figure 9A:
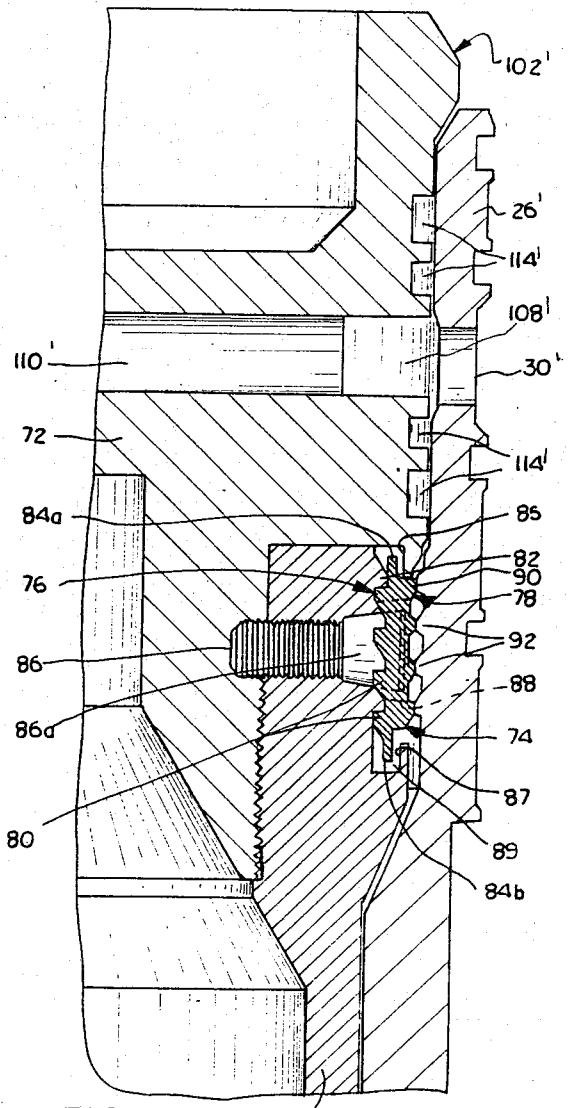

Referring now to FIGS. 9A, 9B, and 9C, another embodiment is shown wherein the shifting tool seal collar 102 can be mated to the shift sleeve 26 without the need to use cooperating threads, thereby permitting a simple non-rotational stab-in as distinguished from a screw-type stab-in shown hereinbefore. It should be noted that this alternative design can also be incorporated in the dual stage shifting tool 150. For clarity, FIGS. 9A-9C only show the coupled portion of the shifting tool 100 and shift sleeve 26. Again, elements which correspond with like elements in FIGS. 3 and 4 are given the same numeral followed with a prime (').

In this embodiment, the seal collar 102' is a two-piece assembly which includes a latch housing 70 threadedly attached to the seal collar body 72. The housing 70 retains an annular, expandable, ratchetlike latch member 74 which has inner and outer latching perimeters 76,78 as illustrated. The inner perimeter 76 has a plurality of projections or teeth 80 which engage corresponding teeth 82 on the housing 70. The latch member 74 can be in the nature of a split ring and is held in the housing 70 by upper and lower flanges **84*a*,84*b*, respectively, which are caged by extensions 85 and 87, respectively, on the seal collar body 72 and housing 70. These extensions 85,87 define a slot 89 which receives the latch member 74 as illustrated. A retaining bolt 86 is transversely threaded into the housing 70 and the bolt head 86*a* extends radially into an oversized bore 88 in the latch member 74**.

During running in, the seal collar 102' and latch member 74 are run in the hole with the shifting tool 100 via the drill pipe until the outer teeth 90 on the perimeter 78 tag a corresponding plurality of teeth 92 on the shift sleeve 26'. This is the position shown in FIG. 9A. The latch member outer teeth 90 cammingly engage the teeth 92 and permit the member 74 to be pushed down and slip over the shift sleeve teeth 92, after which the latch member 74 lockingly snaps into place to connect the shifting tool 100 to the shift sleeve 26' as illustrated in FIG. 9B. The packing and seal elements 114' maintain a fluidtight seal between the collar ports 110' and the shift sleeve ports 30' as described hereinbefore (see FIGS. 3 and 4). The latch member teeth 90 have somewhat radially extending surfaces 91 which engage corresponding surfaces 93 on the shift sleeve teeth 92 in the latched position (FIG. 8B) to prevent separation of the latch member 74 from the shift sleeve 26' by an upward pull. This is important to prevent the shifting tool 100 and shift sleeve 26' from disengaging when the stage collar 10 is opened and closed as described hereinbefore.

Removal of the tool 100 and shift sleeve 26' is accomplished by an upward pull to disengage the latch ring 28 and close the closing sleeve 18 as described and shown hereinabove. As illustrated in FIG. 9C, the bolt head **86*a* engages the upper perimeter of the bore 88 to prevent the latch member teeth 80 from disengaging from the housing teeth 82 when the tool 100 is pulled up for removal. Such disengagement would otherwise occur because, as best shown in FIG. 9B, the housing teeth 82 and latch member inner teeth 80 have corresponding cam surfaces 97 and 98, respectively, which permit the latch member 74 to be compressed radially inwardly when assembled into the slot 89 by slipping down over the housing teeth 82, as for example when the housing 70 is made up with the collar body 72. It should also be noted that the tool 100 can also be unscrewed from the shift sleeve 26' because the teeth 90 and 92 provide a threaded engagement when the latch member 74 is snapped into position. An upward pull on the member 74 via the drill pipe, tool 100 and housing 70 engages the teeth 90,92 as in FIG. 8C and permits the tool 100 to be unscrewed from the sleeve 26'. This would be used, for example, during a three-stage cementing operation wherein the shift sleeve 26** must remain in the lower stage collar as discussed hereinabove (see FIG. 7F).

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A drill pipe actuable stage collar for cementing a well casing in a bore hole comprising a stage collar case adapted to be placed in the well casing at a predeterminable location, said stage collar case including a plurality of ports communicating with an annulus around the well casing, closing sleeve means for opening and closing said stage collar ports, said closing sleeve means being adapted to slidably move from an initial closed position to an open position and to a closed position with respect to said stage collar ports, means for shifting said closing sleeve means from said initial closed position to the open position and subsequently to a closed position, said shifting means being operable by drill pipe movement, and means operably associated with said shifting means and closing sleeve means for locking said closing sleeve means in said closed position, said closing sleeve means, stage collar case and locking means providing a substantially uniform inner diameter bore of the stage collar which does not have to be drilled out after the stage collar is closed.

2. A stage collar according to claim 1, wherein said shifting means includes shift sleeve means connectable to the drill pipe for axial movement therewith, said locking means releasably engageable with said shift sleeve means and said closing sleeve means such that axial movement of said shift sleeve means causes said closing sleeve means to move to said closed position, said locking means disengaging from said shift sleeve means and locking said closing sleeve means when said closed position is reached.

3. A stage collar according to claim 2, wherein said locking means is a latch ring adapted to expand from a first diameter to a second diameter, said latch ring being axially slidable with said shift sleeve means and engageable with said closing sleeve means to move the same.

4. A stage collar according to claim 3, wherein said latch ring expands into and is captured in a gap formed between said closing sleeve means and the stage collar case when said closing sleeve means moves to said closed position, said latch ring being axially trapped between said closing sleeve means and a shoulder on the stage collar case thereby preventing said closing sleeve means from moving back to said open position and forming a smooth and relatively uniform diameter inner bore of the stage collar without drilling out.

5. A stage collar according to claim 4, wherein said latch ring is initially retained in a recess in said shift sleeve means when compressed to said first diameter, said latch ring expanding away from and out of engagement with said shift sleeve means when said latch ring fills said gap.

6. A stage collar according to claim 5, wherein after said latch ring snaps into said gap said shift sleeve means is easily removable from the stage collar by picking up the drill pipe.

7. A stage collar according to claim 2, wherein said closing sleeve means includes a plurality of ports alignable with said stage collar case ports, said closing sleeve means ports and stage collar ports being aligned when said closing sleeve means is in said open position and being out of alignment and fluidtightly sealed from each other when said closing sleeve means is in said closed position.

8. A stage collar according to claim 7, wherein said shift sleeve means includes a plurality of ports alignable with said closing sleeve means ports, said shift sleeve means being adapted to slidably move from a first position in which said shift sleeve means sealingly blocks said closing sleeve means ports to a second position in which said shift sleeve means ports are in fluid communication with said closing sleeve means ports so that said shift sleeve means releasably maintains the stage collar closed during running in and prior to opening the stage collar for a cementing operation.

9. A stage collar according to claim 8, wherein when said shift sleeve means is in said first position said locking means is out of engagement with said closing sleeve means and when said shift sleeve means is in said second position said locking means engages said closing sleeve means by expanding to an intermediate diameter between said first and second diameters so that movement of said shift sleeve means from said first position to said second position opens the stage collar and does not cause movement of said closing sleeve means.

10. A stage collar according to claim 8, wherein said shift sleeve means initial closed position is below said open position.

11. A stage collar according to claim 8, wherein said shift sleeve means initial closed position is above said open position.

12. A stage collar according to claim 8, wherein said shifting means further includes a shifting tool adapted to be connected to the drill pipe and said shift sleeve means, said shift sleeve means being moved from said first position to said second position by drill pipe movement coupled thereto by the shifting tool.

13. A stage collar according to claim 12, wherein said closing sleeve means includes shear screw means for releasably maintaining said closing sleeve means in said open position and wherein said shift sleeve means includes slotted collet fingers which releasably engage a groove in said stage collar case when said shift sleeve means is in said first position, there being a first predeterminable drill pipe force to move said shift sleeve means to said second position and a second predeterminable and relatively greater drill pipe pull force to break said shear screw means thereby permitting said closing sleeve means to move to said closed position via corresponding movement of said shift sleeve means and locking means.

14. A stage collar according to claim 12, further comprising latching means for connecting the shifting tool to said shift sleeve means without a screw-in engagement.

15. A stage collar according to claim 14, wherein said latching means is actuated by axial movement of the drill pipe and is disengageable by rotational movement of the drill pipe.

16. A stage collar according to claim 15, wherein said latching means includes a toothed latch ring retained in a housing in the shifting tool, said toothed latch ring being adapted to snap into engagement with a corresponding toothed portion of said shift sleeve means.

17. A stage collar according to claim 16, wherein said toothed latch ring and shift sleeve means are coupled together after said toothed latch ring snaps into said engagement such that axial movements of the drill pipe do not disengage the shifting tool from said shift sleeve means.

18. A stage collar according to claim 12, wherein said shift sleeve means is adapted to threadedly mate with a threaded collar means on the shifting tool so that the shifting tool can be screwed into and out of the stage collar via said shift sleeve means.

19. A stage collar according to claim 18, wherein when said closing sleeve means is in said closed position said shift sleeve means is disengaged therefrom and said shift sleeve means and the shifting tool can be easily removed from the well hole by pickup fo the drill pipe.

20. A stage collar according to claim 18, wherein the shifting tool includes a sub in fluid communication with the drill pipe, said shifting tool threaded collar means having ports in fluid communication with said sub and alignable with said shift sleeve means ports when the shifting tool is made up into said shift sleeve means, there being seal means for forming a fluidtight stab-in seal between the shifting tool and said shift sleeve means.

21. A stage collar according to claim 20 further comprising seal means for forming a fluidtight alignment between said shift sleeve means ports and said closing sleeve means ports when said shift sleeve means is in said second position and said closing sleeve means is in said open position whereby a direct fluidtight passage is present from the drill pipe to the annulus around the casing and fluid can pass therethrough without entering the casing interior.

22. A stage collar according to claim 1, wherein said shifting means and closing sleeve means cooperate to form a fluidtight passage from the drill pipe to the annulus when the stage collar is opened for a cementing operation.

23. A stage collar according to claim 1, wherein said shifting means permits a drill pipe-operated two-stage cementing operation to be performed with only one run down the well hole, the first cementing stage being performed below and up to the stage collar and the second cementing stage being performed through and above the stage collar.

* * * * *